US009506373B2

(12) United States Patent
Chernysheva et al.

(10) Patent No.: US 9,506,373 B2
(45) Date of Patent: Nov. 29, 2016

(54) STEAM TURBINE ARRANGEMENT OF A THREE CASING SUPERCRITICAL STEAM TURBINE

(71) Applicant: Siemens Aktiengesellschaft, Müenchen (DE)

(72) Inventors: Olga Chernysheva, Finspång (SE); Oskar Mazur, Finspang (SE)

(73) Assignee: SIEMENS AKTIENGESELLSCHAFT, München (DE)

( * ) Notice: Subject to any disclaimer, the term of this patent is extended or adjusted under 35 U.S.C. 154(b) by 780 days.

(21) Appl. No.: 13/686,975

(22) Filed: Nov. 28, 2012

(65) Prior Publication Data

US 2013/0142618 A1 Jun. 6, 2013

(30) Foreign Application Priority Data

Dec. 2, 2011 (EP) ..... 11191727

(51) Int. Cl.

| | |
|---|---|
| ***F01D 25/12*** | (2006.01) |
| ***F01D 9/06*** | (2006.01) |
| ***F01D 11/04*** | (2006.01) |
| ***F01K 7/22*** | (2006.01) |
| ***F01K 17/04*** | (2006.01) |

(52) U.S. Cl.

CPC ..... *F01D 25/12* (2013.01); *F01D 9/065* (2013.01); *F01D 11/04* (2013.01); *F01K 7/22* (2013.01); *F01K 17/04* (2013.01); *F05D 2220/31* (2013.01); *F05D 2260/20* (2013.01)

(58) Field of Classification Search

CPC ..... F01K 27/02; F01K 17/04; F01K 7/22; F01K 13/006; F01K 7/38; F01K 7/44; F01K 9/00; F01D 25/12; F01D 9/065; F01D 11/04; F01D 11/06; F01D 25/08; F01D 5/08; F01D 17/20; F05D 2260/20; F05D 2220/31; F05D 2260/2322; F05D 2260/232; F02C 7/16; F02C 7/12

See application file for complete search history.

(56) References Cited

U.S. PATENT DOCUMENTS

| | | | | |
|---|---|---|---|---|
| 2,552,239 A | | 5/1951 | Warren | |
| 5,613,356 A | * | 3/1997 | Frutschi | F01K 23/106 60/39.182 |
| 5,724,814 A | * | 3/1998 | Ven | F01B 17/00 60/618 |
| 6,263,662 B1 | * | 7/2001 | Nagashima | F01K 23/106 122/7 B |

(Continued)

FOREIGN PATENT DOCUMENTS

| | | |
|---|---|---|
| JP | 60022005 A | 2/1985 |
| JP | 2011102540 A | 5/2011 |
| WO | WO 2010097983 A1 | 9/2010 |

*Primary Examiner* — Igor Kershteyn
*Assistant Examiner* — Eldon Brockman

(57) ABSTRACT

A steam turbine arrangement is provided and includes a first steam turbine with a first steam outlet, wherein the first steam turbine exhibiting a first sealing leakage, a second steam turbine exhibiting a second sealing leakage, and a third steam turbine with a cooling steam inlet, a functional device and a cooling arrangement. The cooling arrangement is coupled to the cooling steam inlet. The cooling arrangement is adapted for guiding a cooling steam to the functional device for cooling purposes. A steam pipe is coupled to the first steam turbine and to the second steam turbine such that a first steam being provided by the first sealing leakage and a second steam being provided by the second sealing leakage is gathered to a cooling steam in the steam pipe. The steam pipe is coupled to the cooling steam inlet such that the cooling steam is injectable to the cooling arrangement.

9 Claims, 2 Drawing Sheets

(56) References Cited

U.S. PATENT DOCUMENTS 6,393,822 B2 * 5/2002 Nagashima ..... F01K 23/106 60/39.182
7,040,861 B2 * 5/2006 Clifford ..... F01D 11/001 415/174.2
7,195,443 B2 * 3/2007 Vandervort ..... F01D 3/02 415/1
7,658,073 B2 * 2/2010 Hernandez ..... F01D 25/12 60/653
8,337,139 B2 * 12/2012 Sanchez ..... F02C 6/04 415/1
8,621,866 B2 * 1/2014 Pieper ..... F01K 7/18 60/618
8,650,878 B2 * 2/2014 Mehra ..... F01D 11/06 60/646
2001/0023577 A1 * 9/2001 Nagashima ..... F01K 23/106 60/772
2004/0261417 A1 * 12/2004 Yamashita ..... F01K 13/006 60/679
2006/0140747 A1 * 6/2006 Vandervort ..... F01D 3/02 415/1
2009/0025389 A1 * 1/2009 Hernandez ..... F01D 25/12 60/663
2011/0110759 A1 * 5/2011 Sanchez ..... F02C 6/04 415/1
2011/0110760 A1 * 5/2011 Sanchez ..... F01K 7/08 415/1
2011/0214426 A1 * 9/2011 Mehra ..... F01D 11/06 60/645
2014/0283518 A1 * 9/2014 Majumdar ..... F01K 7/06 60/677

* cited by examiner

STEAM TURBINE ARRANGEMENT OF A THREE CASING SUPERCRITICAL STEAM TURBINE

CROSS REFERENCE TO RELATED APPLICATIONS

This application claims priority of European Patent Office application No. 11191727.4 EP filed Dec. 2, 2011. All of the applications are incorporated by reference herein in their entirety.

FIELD OF INVENTION

A steam turbine arrangement and to a method for controlling a steam turbine arrangement are provided.

ART BACKGROUND

In modern steam turbine systems, three separately operateable steam turbines are functionally coupled for driving one common generator for generating power. Two high pressure turbines may thereby be coupled to a gear box in order to adjust the turning moment transmitted to the generator. One further intermediate pressure turbine may be directly coupled to the generator.

Each turbine is installed in an individual turbine housing, wherein each turbine housing is functionally decoupled from each other. The steam which exits one turbine may flow to an adjacent turbine. A steam that passes the two high pressure turbines may be guided to a reheater before being injected into the intermediate pressure turbine. The steam from the reheater comprises a high temperature, so that the components of the intermediate pressure turbine may overheat.

SUMMARY OF THE INVENTION

There may be a need to provide a cooling for functional devices of a steam turbine that is exposed to hot steam.

This objective is solved by a steam turbine arrangement and by a method for controlling a steam turbine arrangement according to the subject matters of the independent claims.

According to a first aspect, a steam turbine arrangement is presented. The steam turbine arrangement comprises a first steam turbine with a first steam outlet, wherein the first steam turbine comprises a first sealing leakage. The steam turbine arrangement further comprises a second steam turbine exhibiting a second sealing leakage and a third steam turbine with a cooling steam inlet, at least one functional device and a cooling arrangement. The cooling arrangement guides cooling steam to the functional device for cooling purposes, wherein the cooling arrangement is coupled to the cooling steam inlet.

The steam turbine arrangement further comprises a steam pipe which is coupled to the first steam turbine and the second steam turbine such that a first steam flowing through the first sealing leakage and the second steam flowing through the second sealing leakage is gathered to a cooling steam in the steam pipe. A steam pipe is coupled to the cooling steam inlet such that the cooling steam is injectable to the cooling arrangement.

Furthermore, the steam turbine arrangement further comprises a first extraction control valve which is coupled between the first steam outlet of the first steam turbine and the steam pipe such that an extraction of a first control steam from the first turbine and an injection of the first control steam into the steam pipe is controllable by the first extraction control valve, so that a desired mass flow of cooling steam in the steam pipe is adjustable for controlling the cooling power capacity of the cooling arrangement.

According to a further aspect, a method for controlling the above described steam turbine arrangement is presented. According to the method, the extraction of the first control steam from the first turbine and the injection of the first control steam into the steam pipe by the first extraction control valve are controlled so that the desired mass flow of cooling steam in the steam pipe is adjusted for controlling the cooling power capacity of the cooling arrangement.

The first steam turbine may be a high pressure turbine which receives overheated steam e.g. from a boiler. The (e.g. overheated) steam drives the first steam turbine and in particular the first shaft of the first steam turbine. The first shaft is coupled to a gear. After flowing through the first steam turbine, the steam flows further to the second steam turbine, which may also be a high pressure turbine. The steam drives the second steam turbine and in particular the second shaft of the second steam turbine. The second shaft may also be coupled to the gear.

The gear is further coupled to a generator for generating power. The first turbine shaft and the second turbine shaft drive the gear and hence the generator.

The third steam turbine may be an intermediate steam turbine which receives the steam that exits the second steam turbine. Between the second steam turbine and the third steam turbine a reheater may be coupled for reheating the steam before entering the third steam turbine. The third steam turbine comprises a shaft which is coupled to the generator or to the gear box for transmitting driving torque.

The first steam turbine exhibits a first sealing leakage, through which steam leaks out of the first steam turbine. In particular, the first steam turbine comprises a housing which houses the functional devices or components of the first steam turbine. Due to e.g. gaps between the functional devices steam leaks out. The second steam turbine comprises also functional devices which are housed by a second housing. Also the second steam turbine exhibits a second sealing leakage through which steam leaks out. Also the third steam turbine comprises functional components/devices, such as rotor blades and a third turbine shaft, which are housed in a third housing of the third steam turbine.

The first steam turbine, the second steam turbine and the third steam turbine operate functionally independent from each other, that is that no functional components or devices are shared by two of the three steam turbines, for example. Each steam turbine components are housed in a respective housing. Hence, an arrangement with the first steam turbine, the second steam turbine and the third steam turbine, which do not share common functional components, may be called a three casing steam turbine arrangement.

At the input of the first steam turbine, the steam is hot e.g. due to a reheating in the reheater. Hence, by the steam turbine arrangement, a cooling for cooling functional devices of the third steam turbine is provided. A steam pipe is coupled to (e.g. the first housing of) the first steam turbine, (e.g. the second housing of) the second steam turbine and (e.g. the cooling arrangement of) the third steam turbine.

The steam that leaks through the first sealing leakage and the steam that leaks through the second sealing leakage are gathered into the steam pipe. The mass flow of the steam leaking through the first sealing leakage and the second sealing leakage is based on the design, i.e. the gap sizes and clearance, and the operating point (temperature, steam pressure) of the first steam turbine and the second steam turbine.

The steam flowing through the steam pipe may be called cooling steam. The cooling steam may have under operating conditions of the steam turbine arrangement a lower temperature than the main steam that enters the third steam turbine at a main steam inlet for driving the third steam turbine. During starting and stopping of the turbine arrangement the cooling steam may also have a higher temperature than the main steam. Hence, the cooling steam of the cooling pipe may be used to be fed into the cooling arrangement of the third steam turbine for cooling purposes. In order to adjust the cooling power capacity of the cooling arrangement, the parameters (mass flow, temperature) of the cooling stream flowing in the steam pipe is controlled e.g. by the first extraction control valve.

The first extraction control valve is coupled between the first steam outlet of the first steam turbine and the steam pipe. The first steam outlet may be located downstream of the first steam turbine, where the main steam exits the first steam turbine. The first extraction control valve (such as a continuously controllable valve) controls the first control steam that is drained off from the first steam turbine and is injected into the steam pipe.

The first control steam may comprise a temperature that is higher than the temperature of a steam that leaks by the first sealing leakage at the downstream position of the first steam turbine. Hence, the temperature of the first control steam may be higher than the temperature of the cooling steam in the steam pipe. Hence, by controlling the extraction of a first control steam into the steam pipe, the temperature and the mass flow of the cooling steam are adjustable and hence the cooling power capacity of the cooling arrangement.

The first sealing leakage and the second sealing leakage are not controllable and depend on the gap size (clearance) and the operating point of the respective steam turbine. In comparison thereto, the first steam outlet through which a predefined amount of steam may be drained off from the respective first steam turbine. The first extraction control valve controls exactly the mass flow of the drained off steam through the first steam outlet.

According to further exemplary embodiments, the steam turbine arrangement comprises a draining control valve. The draining control valve is coupled to the steam pipe such that the cooling steam is drainable off from the steam pipe for adjusting the desired mass flow of the cooling steam.

Furthermore, if the cooling steam in the cooling pipe is too high and/or the mass flow of the cooling fluid is too high in the cooling pipe, the draining control valve opens and at least a part of the mass flow may be extracted through the draining control valve until a desired cooling temperature and a desired mass flow of the cooling fluid in the cooling pipe is reached. Simultaneously, the first extraction control valve may be closed.

According to a further exemplary embodiment, the steam turbine arrangement comprises a main control valve, wherein the main control valve is coupled to the steam pipe such that the cooling steam at the cooling steam inlet is controllable.

According to a further exemplary embodiment, the first sealing leakage comprises a first downstream leakage at the downstream location of the first turbine and/or a first upstream leakage at an upstream location of the first steam turbine.

According to a further exemplary embodiment, the first control steam has a control temperature which is higher than the temperature of the steam flowing through the first downstream leakage.

According to a further exemplary embodiment, the second sealing leakage comprises a second downstream leakage at a downstream location at the first turbine and/or a second upstream leakage at an upstream location of the first steam turbine.

According to a further exemplary embodiment, the steam turbine arrangement comprises a second extraction control valve, wherein the second turbine comprises a second steam outlet. The second extraction control valve is coupled between the second steam outlet of the second steam turbine and the steam pipe such that an extraction of the second control steam from the second turbine and an injection of the second control steam into the steam pipe is controllable by the second extraction control valve, so that the desired mass flow of cooling steam in the steam pipe is adjustable for controlling the cooling power capacity of the cooling arrangement.

Hence, by the control of the injection of the first control steam by the first extraction control valve and additionally by controlling an extraction of the second control steam by the second extraction control valve, a more exact temperature adjustment and mass flow adjustment of the cooling steam in the steam pipe is provided.

According to a further exemplary embodiment, the steam turbine arrangement comprises a measurement arrangement for measuring the desired mass flow and the control temperature of the first control steam. Furthermore, the steam turbine arrangement comprises a control unit which is coupled to the measurement arrangement and to the first extraction control valve such that the control unit controls the first extraction control valve on the basis of the measured mass flow and the control temperature of the first control steam.

It has to be noted that embodiments have been described with reference to different subject matters. In particular, some embodiments have been described with reference to apparatus type claims whereas other embodiments have been described with reference to method type claims. However, a person skilled in the art will gather from the above and the following description that, unless otherwise notified, in addition to any combination of features belonging to one type of subject matter also any combination between features relating to different subject matters, in particular between features of the apparatus type claims and features of the method type claims is considered as to be disclosed with this application.

BRIEF DESCRIPTION OF THE DRAWINGS

The aspects defined above and further aspects are apparent from the examples of embodiment to be described hereinafter and are explained with reference to the examples of embodiment.

DETAILED DESCRIPTION

Figure 1:
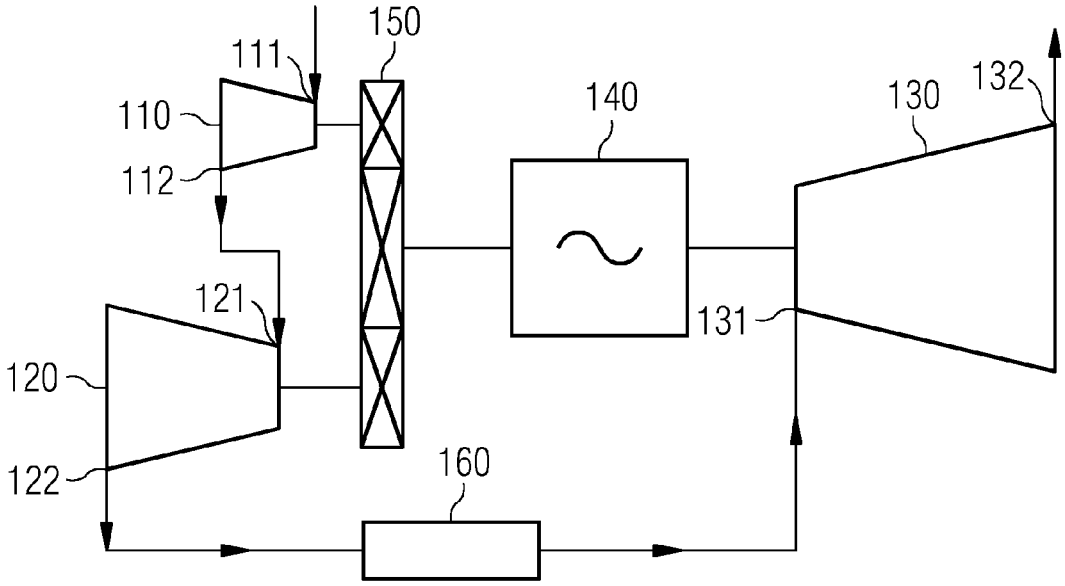
FIG. 1 shows a three-casing steam turbine arrangement according to an exemplary embodiment.

The illustrations in the drawings are schematical. It is noted that in different figures, similar or identical elements are provided with the same reference signs.

FIG. 1 shows a three-casing steam turbine arrangement. The steam turbine arrangement comprises a first steam turbine 110, a second steam turbine 120 and a third steam turbine 130. Each steam turbine 110, 120, 130 comprises respective functional components, such as respective turbine shafts and rotating blades, for example.

The functional components/devices of the first steam turbine 110 are housed in a first casing, the functional components/devices of the second steam turbine 120 are housed in a second casing and the functional components/devices of the third steam turbine 130 are housed in a third casing. Each steam turbine 110, 120, 130 is functionally decoupled by each other, i.e. the turbine shafts do not directly interact with each other, for example. The first steam turbine 110, the second steam turbine 120 and the third steam turbine 130 may be coupled by a common steam flow. For example, at the first main steam inlet (overheated steam) from a boiler may be injected into the first steam turbine 110. After driving the first steam turbine 110, the steam exits the first steam turbine 110 is guided to a second main steam inlet 121 of the second steam turbine 120. After driving the second steam turbine 120, the steam is extracted through a second main steam outlet 122 and is guided to a third main steam inlet 131 of the third steam turbine.

Between the second steam turbine 120 and the third steam turbine 130 a reheater 160 may be coupled, such that the steam may be overheated again before being injected into the third steam turbine 130. After driving the third steam turbine 130, the steam is drained off through the third main steam outlet 132.

The first steam turbine 110 and the second steam turbine 120 may be high pressure steam turbines. The respective steam turbine shafts of the first steam turbine 110 and the second steam turbine 120 are coupled to a gear 150. The gear 150 transmits a desired driving torque to a driving shaft of a generator 140 which generates power.

The third steam turbine 130 may be an intermediate pressure turbine which driving shaft may be directly coupled to the driving shaft of the generator 140.

At the respective first main steam inlets 111, 121, 131 and the respective main steam outlets 112, 122, 132, a sealing leakage occurs due to various gaps and clearances based on different operating conditions of the respective steam turbines 110, 120, 130. The steam that leaks through the respective steam leakages is gathered for example in the respective casings of the respective steam turbines 110, 120, 130, wherein the leaked steam may be forwarded from the respective housings to the steam pipe 205 (see FIG. 2).

Figure 2:
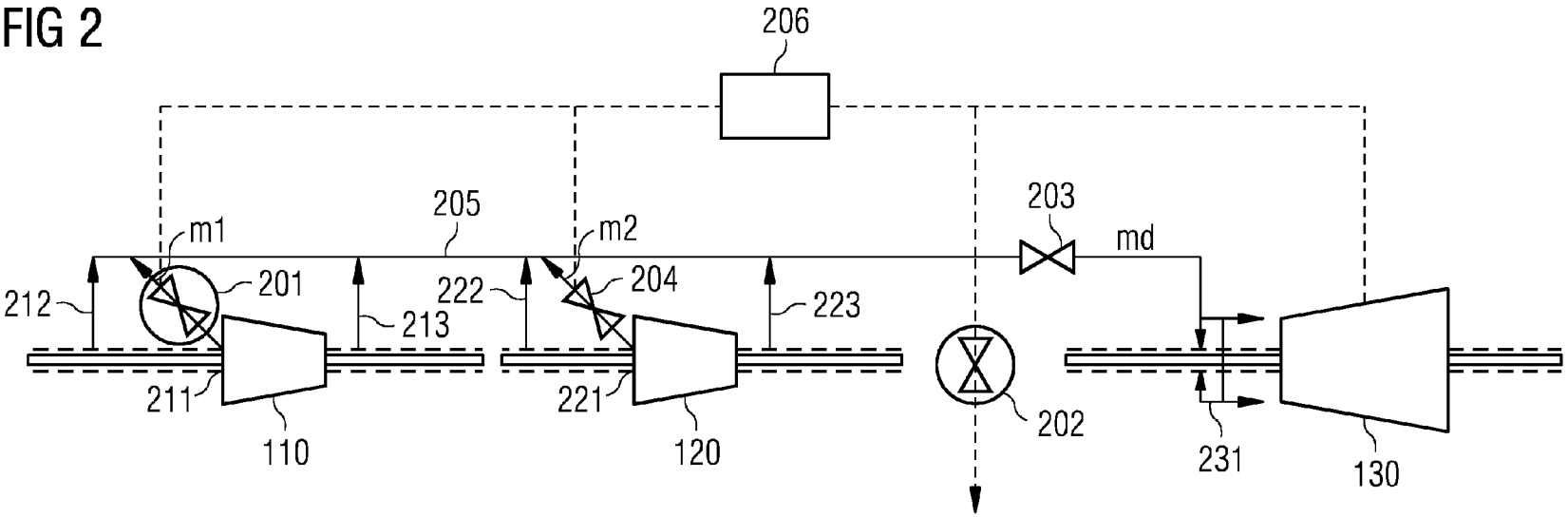
FIG. 2 shows a schematical view of a steam turbine arrangement according to an exemplary embodiment.

FIG. 2 shows an exemplary embodiment of the steam turbine arrangement e.g. as shown in FIG. 1.

For a better overview, only the first steam turbine 110, the second steam turbine 120 and the third steam turbine 130 of the steam turbine arrangement of FIG. 1 is shown in FIG. 2.

The first steam turbine 110 comprises a first sealing leakage with a first downstream leakage 212 and a first upstream leakage 213. The second steam turbine 120 comprises a second sealing leakage with a second downstream leakage 222 and a second upstream leakage 223. The third steam turbine 130 comprises a cooling steam inlet 231, at least one functional device and a cooling arrangement which guides the cooling steam to the functional devices for cooling purposes, wherein the cooling arrangement is coupled to the cooling steam inlet 231.

The steam pipe 205 is coupled to the first steam turbine 110 and the second steam turbine 120 such that a first steam flowing through the first sealing leakage and the second steam flowing through the second leakage is gathered to a cooling steam in the steam pipe 205.

The first steam turbine 110 comprises a first steam outlet 211 through which a part of the main steam flowing through the first steam turbine 110 may be extracted. The steam pipe 205 is coupled to the cooling steam inlet 231 such that a part of the main steam is used for the cooling steam. The cooling steam is injectable into the cooling arrangement.

A first extraction control valve 201 is coupled between the first steam outlet 211 of the first steam turbine 110 and the steam pipe 205 such that an extraction of the first control steam m1 from the first steam turbine 110 and an injection of the first control steam m1 into the steam pipe 205 is controllable by the first extraction control valve 201. Hence, a desired mass flow and of cooling steam in the steam pipe 205 is adjustable for controlling the cooling power capacity of the cooling arrangement.

Furthermore, the steam turbine arrangement may comprise a second extraction control valve 204 which is coupled between a second steam outlet 221 of the second steam turbine 120 and the steam pipe 205 such that an extraction of a second control steam m2 from the second turbine and an injection of the second control steam M2 into the steam pipe 205 is controllable by the second extraction control valve 204, so that the desired mass flow md of cooling steam in the steam pipe 205 is adjustable to control the cooling power capacity of the cooling arrangement. Hence, in the steam pipe 205, the cooling steam is composed of steam flowing through the first uncontrollable downstream leakage 212, a first uncontrollable upstream leakage 213, a second uncontrollable downstream leakage 222 and a second uncontrollable upstream leakage 223 into the steam pipe 205. Additionally, a controllable mass flow, in particular a first control steam m1 and/or a second controllable steam m2, is additionally injectable into the steam pipe 205 in a controlled manner by the first extraction control valve 201 and/or the second extraction control valve 204.

Furthermore, if the desired mass flow md and/or the temperature of the cooling steam is too high, cooling steam may be exhausted to the environment by a draining control valve 202 which is coupled to the steam pipe 205.

Additionally, the total desired mass flow md may also be controlled by a main control valve 203 which is coupled to the steam pipe 205 close to the cooling steam inlet 231 of the third steam turbine 130.

As shown in FIG. 2, the cooling steam in the steam pipe 205 may be injected to a cooling arrangement of the third steam turbine 130. The cooling arrangement is adapted for cooling functional devices of the third steam turbine 130. Hence, dependent on the desired mass flow md and the temperature of the cooling steam in the steam pipe 205, the cooling power capacity of the cooling arrangement is adjusted. In order to control the cooling power capacity of the cooling arrangement, a measurement arrangement for measuring the desired mass flow md, the control temperature of the first steam m1 and/or the control temperature of the second control steam m2. Furthermore, a control unit 206 may be coupled to the measurement arrangement, to the first extraction control valve 201, to the draining control valve 202, to the main control valve 203 and/or to the second extraction control valve 204. The control unit 206 is adapted for controlling the respective control valves 201, 202, 203, 204 such that the desired mass flow md and the desired cooling temperature of the cooling steam is adjusted.

Furthermore, the measurement arrangement may measure by respective sensors the temperature of the functional devices to be cooled of the third steam turbine 130 and the cooling capacity of the cooling arrangement. Hence, the control unit 206 may also control at least one of the respective control valves 201, 202, 203, 204 on the basis of the temperature of the functional devices of the third steam turbine 130 and the measured cooling capacity of the cooling arrangement.

For example, in order to achieve a desired mass flow md and a desired cooling temperature of the cooling steam at the cooling steam inlet 231, the first extraction control valve 201 may be opened and a desired first control steam m1 of a cooling steam is introduced into the steam pipe 205. Hence, the steam from the first downstream leakage 212, the extracted steam from the first steam outlet 211, the steam from the first upstream leakage 213, the steam from the second downstream leakage 222, the steam from the second steam outlet 221 and the steam from the second upstream leakage 223 are summed up together in the steam pipe 205 and flows to the cooling steam inlets 231 of the third steam turbine 230.

If the cooling temperature of the cooling steam at the cooling steam inlet 231 is too low, the first extraction control valve 201 and/or the second extraction control valve 204 may be opened until the desired mass flow md of the cooling steam and the desired cooling temperature of the cooling steam is reached. Simultaneously, the draining control valve 102 may be closed, such that the desired mass flow md is not reduced.

If the cooling temperature of the cooling steam at the cooling steam inlet 231 is too high, the draining control valve 102 may be opened and the cooling steam may be exhausted through the draining control valve 202 until the desired mass flow md and the desired cooling temperature of the cooling steam at the cooling steam inlet 231 is reached. Simultaneously, the first extraction control valve 201 and/or the second extraction control valve 204 may be closed such that no flow of control steam flows from the first steam turbine 110 or the second steam turbine 120 to the steam pipe 205.

The first extraction control valve 201, the draining control valve 202, the main control valve 203 and/or the second extraction control valve 204 control a desired mass flow and of cooling fluid in the steam pipe 205, since the maximum amount of mass flow of a steam through the upstream leakages 213, 223 and downstream leakages 212, 222 are defined by the sealing capacity of the respective steam turbines 110, 120 and the operating points of the respective steam turbines 110, 120. In other words, the steam flowing through the respective leakages 212, 213, 222, 223 cannot be controlled, i.e. increased or reduced, during operation, as it would preferably be required the a cooling arrangement of the intermediate third steam turbine 130.

It should be noted that the term "comprising" does not exclude other elements or steps and "a" or "an" does not exclude a plurality. Also elements described in association with different embodiments may be combined. It should also be noted that reference signs in the claims should not be construed as limiting the scope of the claims.

We claim:

1. A steam turbine arrangement, comprising a first steam turbine with a first steam outlet, the first steam turbine exhibiting a first sealing leakage;

a second steam turbine exhibiting a second sealing leakage;

a third steam turbine with a cooling steam inlet and rotor blades, and which is configured to guide a cooling steam to cool the rotor blades;

wherein the first steam turbine, the second steam turbine, and the third steam turbine is functionally decoupled by each other;

a steam pipe, coupled to the first steam turbine and to the second steam turbine such that a first steam provided by the first sealing leakage and a second steam provided by the second sealing leakage is gathered to provide the cooling steam in the steam pipe; and a first extraction control valve, wherein the steam pipe is coupled to the cooling steam inlet such that the cooling steam is injectable to the cooling steam pipe, and wherein the first extraction control valve which is coupled between the first steam outlet of the first steam turbine and the steam pipe such that an extraction of a first control steam from the first steam turbine and an injection of the first control steam into the steam pipe is controllable by the first extraction control valve, so that a desired mass flow of cooling steam in the steam pipe is adjustable for controlling the cooling power capacity of the cooling steam guided to cool the rotor blades.

2. The steam turbine arrangement according to claim 1, further comprising a draining control valve, wherein the draining control valve is coupled to the steam pipe such that cooling steam is drainable off from the steam pipe for adjusting the desired mass flow of the cooling steam.

3. The steam turbine arrangement according to claim 1, further comprising a main control valve, wherein the main control valve is coupled to the steam pipe such that the cooling steam at the cooling steam inlet is controllable.

4. The steam turbine arrangement according to claim 1, wherein the first sealing leakage comprises a first downstream leakage at a downstream location of the first steam turbine and/or a first upstream leakage at an upstream location of the first steam turbine.

5. The steam turbine arrangement according to claim 4, wherein the first control steam comprises a control temperature which is higher than a temperature of a steam flowing through the first downstream leakage.

6. The steam turbine arrangement according to claim 1, wherein the second sealing leakage comprises a second downstream leakage at a downstream location of the first steam turbine and/or a second upstream leakage at an upstream location of the second steam turbine.

7. The steam turbine arrangement according to claim 1, further comprising a second extraction control valve, wherein the second steam turbine comprises a second steam outlet, wherein the second extraction control valve is coupled between the second steam outlet of the second steam turbine and the steam pipe such that an extraction of a second control steam from the second steam turbine and an injection of the second control steam into the steam pipe is controllable by the second extraction control valve, and wherein the desired mass flow of cooling steam in the steam pipe is adjustable for controlling the cooling power capacity of the cooling steam guided to cool the rotor blades.

8. The steam turbine arrangement according to claim 1, further comprising sensors that measure the mass flow of the cooling steam in the steam pipe and the control temperature of the first control steam, and wherein the extraction control valve is configured to operate based on the measured mass flow of the cooling steam in the steam pipe and the control temperature of the first control steam.

9. A method for controlling a steam turbine arrangement, as claimed in claim 1, for cooling a steam turbine arrangement, comprising:

controlling an extraction of the first control steam from the first steam turbine and an injection of the control steam into the steam pipe by the first extraction control valve, so that a desired mass flow of cooling steam in the steam pipe is adjusted for controlling the cooling power capacity of the cooling steam guided to cool the rotor blades.

* * * * *